US010145155B2

(12) United States Patent
Mathofer

(10) Patent No.: US 10,145,155 B2
(45) Date of Patent: Dec. 4, 2018

(54) DOOR HANDLE ASSEMBLY FOR A MOTOR VEHICLE WITH HANDLE GUIDANCE

(71) Applicant: HUF HUELSBECK & FUERST GMBH & CO. KG, Velbert (DE)

(72) Inventor: Reinhold Mathofer, Wulfrath (DE)

(73) Assignee: HUF HUELSBECK & FUERST GMBH & CO. KG, Velbert (DE)

( * ) Notice: Subject to any disclaimer, the term of this patent is extended or adjusted under 35 U.S.C. 154(b) by 412 days.

(21) Appl. No.: 14/961,199

(22) Filed: Dec. 7, 2015

(65) Prior Publication Data

US 2016/0160538 A1 Jun. 9, 2016

(30) Foreign Application Priority Data

Dec. 9, 2014 (DE) ..... 10 2014 018 095

(51) Int. Cl.
*E05B 85/10* (2014.01)
*E05B 85/16* (2014.01)
(Continued)

(52) U.S. Cl.
CPC ..... *E05B 85/10* (2013.01); *E05B 85/16* (2013.01); *E05B 15/1635* (2013.01); *E05B 17/007* (2013.01); *E05B 77/36* (2013.01)

(58) Field of Classification Search
CPC .... Y10T 292/57; Y10S 292/53; Y10S 292/56; Y10S 292/57; Y10S 292/63; E05B 79/06;
(Continued)

(56) References Cited

U.S. PATENT DOCUMENTS

2006/0038417 A1* 2/2006 Pudney ..... E05B 85/16 292/336.3
2010/0225127 A1* 9/2010 Muller ..... E05B 85/16 292/336.3

(Continued)

FOREIGN PATENT DOCUMENTS

DE 102009043933 A1 * 3/2011 ..... E05B 85/16
EP 1895081 A1 * 3/2008 ..... E05B 79/06
EP 2201203 B1 * 5/2014 ..... E05B 85/16

OTHER PUBLICATIONS

Computer-Generated Translation for DE 102009043933, Generated on Mar. 20, 2018, https://worldwide.espacenet.com/ (Year: 2018).*

*Primary Examiner* — Alyson M Merlino
(74) *Attorney, Agent, or Firm* — Bacon & Thomas, PLLC

(57) ABSTRACT

The invention relates to a door handle having a handle for a motor vehicle, which handle is arranged in a handle housing and which is displaceable from a rest position into an operating position by means of a rotation around a rotation axis, wherein a handle hook arranged on the free end of the rear side of the handle is kinematically coupled with a deflection lever, wherein the deflection lever directly or indirectly acts on a motor vehicle door lock when being displaced from the rest position into the operating position in order to effect a release of the lock and to enable opening the motor vehicle door, the handle hook comprising at least one guidance element by means of which the handle hook is guided in a corresponding profile of the handle housing, the guidance element performing a form-fit with the handle hook.

11 Claims, 9 Drawing Sheets

(51) Int. Cl.
*E05B 77/36* (2014.01)
*E05B 15/16* (2006.01)
*E05B 17/00* (2006.01)

(58) Field of Classification Search
CPC ..... E05B 85/10; E05B 85/14; E05B 85/16; E05B 17/007; E05B 77/36; E05B 77/40
See application file for complete search history.

(56) References Cited

U.S. PATENT DOCUMENTS

2010/0325841 A1* 12/2010 Savant ..... E05B 85/16 16/412
2014/0150720 A1* 6/2014 Hochholzer ..... E05B 85/16 118/500

* cited by examiner

DOOR HANDLE ASSEMBLY FOR A MOTOR VEHICLE WITH HANDLE GUIDANCE

BACKGROUND OF THE INVENTION

The invention relates to a door handle for a motor vehicle having a handle arranged in a handle housing and which is displaceable from a rest position into an operating position by means of a rotation around a rotation axis, wherein a handle hook arranged on the free end of the rear side of the handle is kinematically coupled with a deflection lever, wherein the deflection lever when being displaced from the rest position into the operating position directly or indirectly acts on a motor vehicle door lock to effect a release of the lock and to allow opening the motor vehicle door.

Door handle assemblies of the above type for actuating a motor vehicle door are known from the prior art. The drawback of the known assemblies is that said assemblies may provide the user with a negative haptic impression if the handle hook arranged on the free end of the rear side of the handle wobbles back and forth due to the bearing clearance on the rotation axis, around which the handle is displaceable from its rest position into an operating position. However, undesired noise may appear when actuating the door handle of the motor vehicle if said region, in which the handle hook is arranged on the free end of the handle, forms a guidance that is too narrow.

Therefore the object of the present invention is to further develop a motor vehicle door handle assembly for actuating a motor vehicle door such that said door has an improved guidance in particular of the handle hook.

SUMMARY OF THE INVENTION

According to the invention, this object is achieved by a motor vehicle door handle assembly.

In the door handle for a motor vehicle having a handle, which is arranged in a handle housing and which is displaceable from a rest position into an operating position by means of a rotation around a rotation axis, wherein a hook handle arranged on the free end of the rear side of the handle is kinematically coupled with a deflection lever, wherein the deflection lever when being displaced from the rest position into the actuation position directly or indirectly acts on a door lock of a motor vehicle in order to effect a release of the door lock and to allow opening the motor vehicle door, it is particularly advantageous that the handle hook comprises at least one guidance element by means of which the handle hook is guided in a corresponding profile of the handle housing, wherein the guidance element performs a form-fit with the handle hook.

Accordingly, the handle is grasped by the user and displaced from the rest position into the opening position for opening the motor vehicle door when the motor vehicle door lock is unlocked. The handle comprises a handle hook on the rear side of said handle, which hook is directly or indirectly kinematically coupled with the deflection lever. When the handle is displaced from the rest position into the opening position, a rotation of the deflection lever around its rotation axis from the rest position into the operating position is effected due to the kinematic coupling of the handle with the deflection lever, so that an opening of the motor vehicle door is possible when the door lock of the motor vehicle is unlocked.

Due to the fact that the handle hook comprises at least one guidance element, by means of which the handle hook is guided in a corresponding profile of the handle housing, the handle has an overall significantly reduced tilting clearance, in particular less than +/−1°, particularly preferred less than +/−0.5°. By means of this minimum tilting clearance, the haptic impression of the motor vehicle door handle is significantly improved for the user since the handle hook is guided by means of the guidance element and the bearing clearance in the region of the rotation axis, around which the handle is rotatable from the rest position into the operating position, is compensated by the guidance element.

Further, by means of this guidance element provided as an additional component, it is possible to combine various materials that have improved sliding properties. In particular, the guidance element can be made of a material having optimized sliding properties, so that particularly undesired noise, such as a squeaking when actuating the motor vehicle door handle, is prevented effectively.

Due to the fact that the guidance element performs a form-fit with the handle hook, an optimum fixing and assembling of the guidance element to the handle hook is possible in a particularly advantageous and simple manner.

Preferably, the handle hook comprises on its free end laterally protruding coupling pins inserted in corresponding recesses on the deflection lever. Such coupling pins, which protrude laterally from the free end of the handle hook, thus form the bearing for the deflection lever.

The end of the handle hook facing the deflection lever is referred to as the free end of the handle hook. The handle hook is kinematically coupled with the deflection lever via the free end.

Particularly preferred, the guidance element engages around the coupling pins in an at least partially form-fit manner. With the guidance element not only engaging around the handle hook in a form-fit manner, but further at least partially around the coupling pins, coupling with the deflection lever is optimized, since the guidance element forms the bearing region for coupling with the deflection lever at the same time as a result. In the region of the bearing of the bearing pins with the deflection lever, the guidance profile then preferably serves as a sliding element having optimized sliding properties.

Particularly preferred, the guidance element is configured as a U-shaped profile, which is plugged-on from one side over the handle hook. Here, the handle hook may particularly have a rectangular cross-section, wherein the cross-sectional area of the handle hook can be variable or constant over the length of the handle hook. Thus, the perpendicular section through the handle hook may correspond to a rectangle as well. The handle hook can have an overall bent contour, in particular entirely or sectionally correspond to a section of a circular arc, so that the handle hook is located at least partially on a circular arc around the rotational axis of the handle.

Thus, the guiding element preferably forms a sliding shoe for the handle hook. Said sliding shoe at least partially engages around the handle hook, preferably in the form of a U-shaped profile engaging beyond the handle hook.

The guidance profile preferably comprises latching lugs, which engage into undercuts and/or recesses in the handle hook. Alternatively or cumulatively, the handle hook may comprise latching lugs on its outer contour, which engage into corresponding undercuts and/or recesses and or break-throughs in the guidance element. By means of such latching lugs on the guidance element and/or on the handle hook, which engage in undercuts and/or recesses in the handle hook or the guidance element respectively, it is possible to plug the guidance element, which performs a form-fit with the handle hook, onto the handle hook in a simple manner and to fix it to the counter part by clipping the latching lugs into the corresponding undercuts and/or recesses.

Particularly preferred, the guidance element further comprises positive guidance profiles running longitudinally on the outer side which interact with negative guidance profiles in the profile of the handle housing guiding the handle hook. Accordingly, rips can be arranged on the outer side of the guidance profile, which slide along in corresponding recesses in the profile of the handle housing guiding the handle hook. Here, the term "running longitudinally" refers to the longitudinal direction, i.e. the movement direction of the handle hook when the handle is turned around its rotation axis for actuating the door handle of the motor vehicle.

Alternatively or cumulatively, the guidance element may comprise negative guidance profiles running longitudinally on the outer side, which interact with positive guidance profiles in the profile of the handle housing guiding the handle hook. In this case, the profile of the handle housing guiding the handle hook comprises projections, which engage into the grooves running on the outer side on the guidance element.

Accordingly, such guidance profiles running longitudinally form outer rips and/or recesses, which interact with corresponding recesses and/or rips on the profile of the handle housing guiding the handle hook. This achieves an optimized guidance of the handle hook and which compensates the bearing clearance, so that the handle of the motor vehicle door handle has an overall minimized tilting clearance and is guided in the handle housing in an optimum manner.

In particular a profile insert, in particular of a material having improved sliding properties, can be inserted in the breakthrough in the handle housing, which breakthrough is engaged through by the handle hook on the handle. This profile insert is contoured correspondingly and interacts with the guidance element on the handle hook, which element has a profiled surface particular on the outer side.

The handle and the handle hook are preferably formed in one piece. Alternatively, the handle hook can be fixed to the handle as a separated component, for example by means of a screw connection and/or a form-fit and/or a force-fit. In particular, the handle and the handle hook can be made of fiber-reinforced polyamide.

Particularly preferably, the guidance element is made of synthetic material, in particular polyoxymethylene. This material has optimized sliding properties compared to the material of the handle hook, so that the handle hook comprising the guidance element can slide along in the profile receiving the handle hook inside the handle housing in an optimum manner.

Preferably, the deflection lever and/or the handle of the motor vehicle door handle are spring-loaded in direction of the rest position. This ensures that upon release of the user the handle automatically re-pivots into its rest position by means of a rotation around its rotation axis.

By spring loading the deflection lever and/or the handle in such a way it is ensured that the deflection lever and the handle are re-displaced into the rest position upon release of a user, since the deflection lever and the handle are directly or indirectly kinematically coupled.

Preferably, the deflection lever is coupled with the motor vehicle door lock by means of a thrust rod and/or a pull rod and/or a cable pull, which is why—if the motor vehicle door lock is not locked—opening of the motor vehicle door is effected with the rotation of the deflection lever into its operating position.

In a preferred embodiment the deflection lever comprises at least one latch element, which upon occurrence of an external impulse due to a lateral impact engages with a crash barrier and blocks a displacement of the deflection lever and the handle from its rest position into its operating position.

By arranging such crash barrier, an undesired displacement of the deflection lever into the operating position along with an undesired release of the unlocked motor vehicle door lock can be prevented in the case of a crash. In this case, such a crash barrier, due to an external impulse due to an impact, in particular a lateral impact, can be engaging an thus block a displacement of the deflection lever from the rest position into its operating position.

Accordingly, moveable masses, potential spring rates with a spring load being exerted, and smoothness of the joints of the motor vehicle door handle assembly and particularly of the crash barrier are selected such that upon occurrence of an impulse, for example due to a crash, the crash barrier is that smooth and provides a corresponding inertness that first the crash barrier engages with the latch element on the deflection lever, thus blocking the deflection lever, before handle and deflection lever can be displaced out of the rest position due to the impulse. Opening of the door due to an impact or another event is reliably prevented due to this crash safety mechanism.

Such a crash barrier can particularly be formed of a circular disc comprising one or multiple recesses, which when in its rest position allows pivoting of the deflection lever into the release position, in that a latching lug arranged on the deflection lever drives into a recess of the circular disc. In the case of an external impulse, such as a crash of the vehicle, the circular disc is rotated into a blocking position by means of inert masses, which engage respective catches on the circular disc, thus blocking the deflection lever and preventing the motor vehicle door lock from inadvertently being released. Further, in this case a return spring is disposed which turns the circular disc in direction of the rest position.

An embodiment of the invention is illustrated in the figures and will be explained below.

BRIEF DESCRIPTION OF THE DRAWINGS

The figures show in:

FIG. 3 a perspective view of the assembly according to FIG. 1 with a handle displaced into the operating position FIG. 4 an enlarged detail of the handle hook with a guidance element plugged-on;

DETAILED DESCRIPTION OF THE INVENTION

Figure 1:
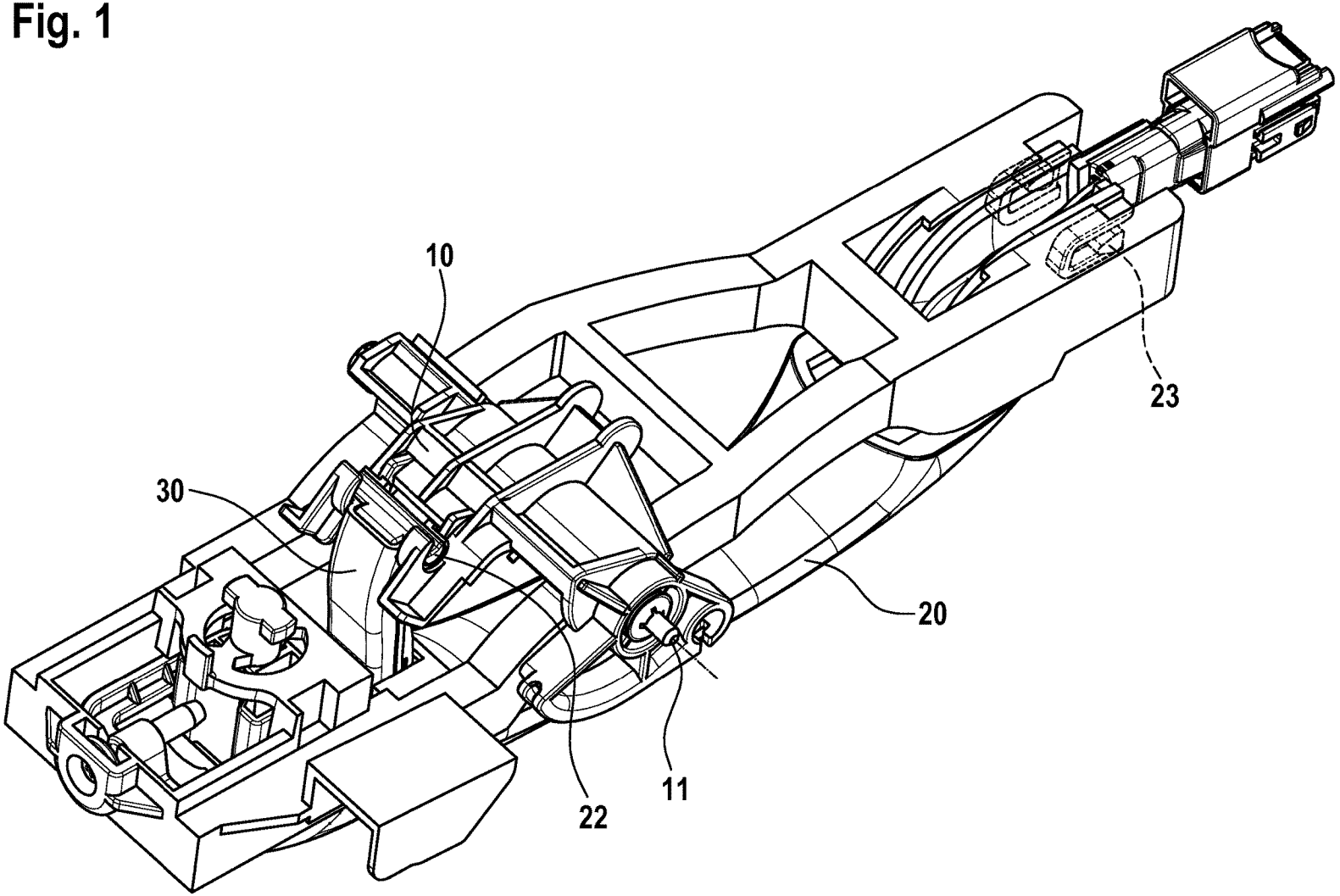
FIG. 1 a perspective view of a part of a motor vehicle door handle assembly in the rest position.
Figure 2:
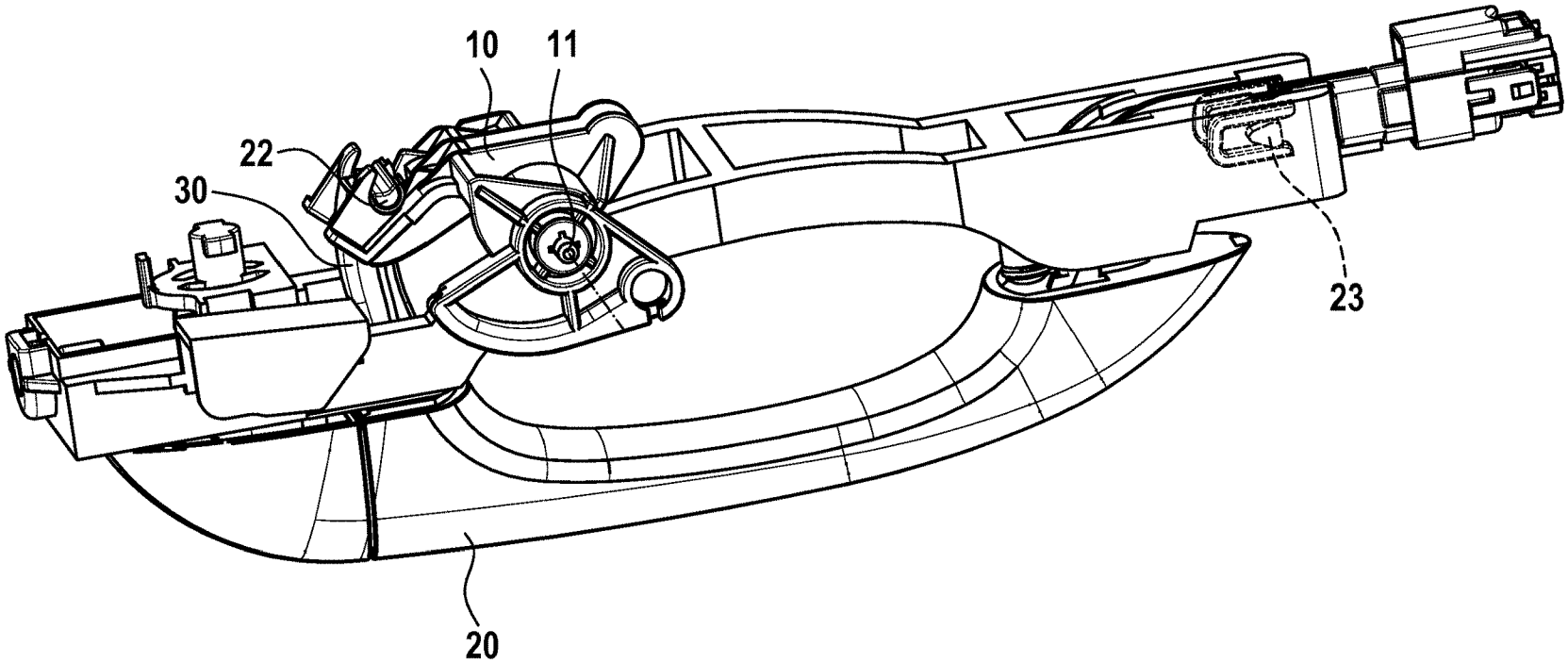
FIG. 2 another perspective view of the assembly according to FIG. 1 in the rest position.
Figure 3:
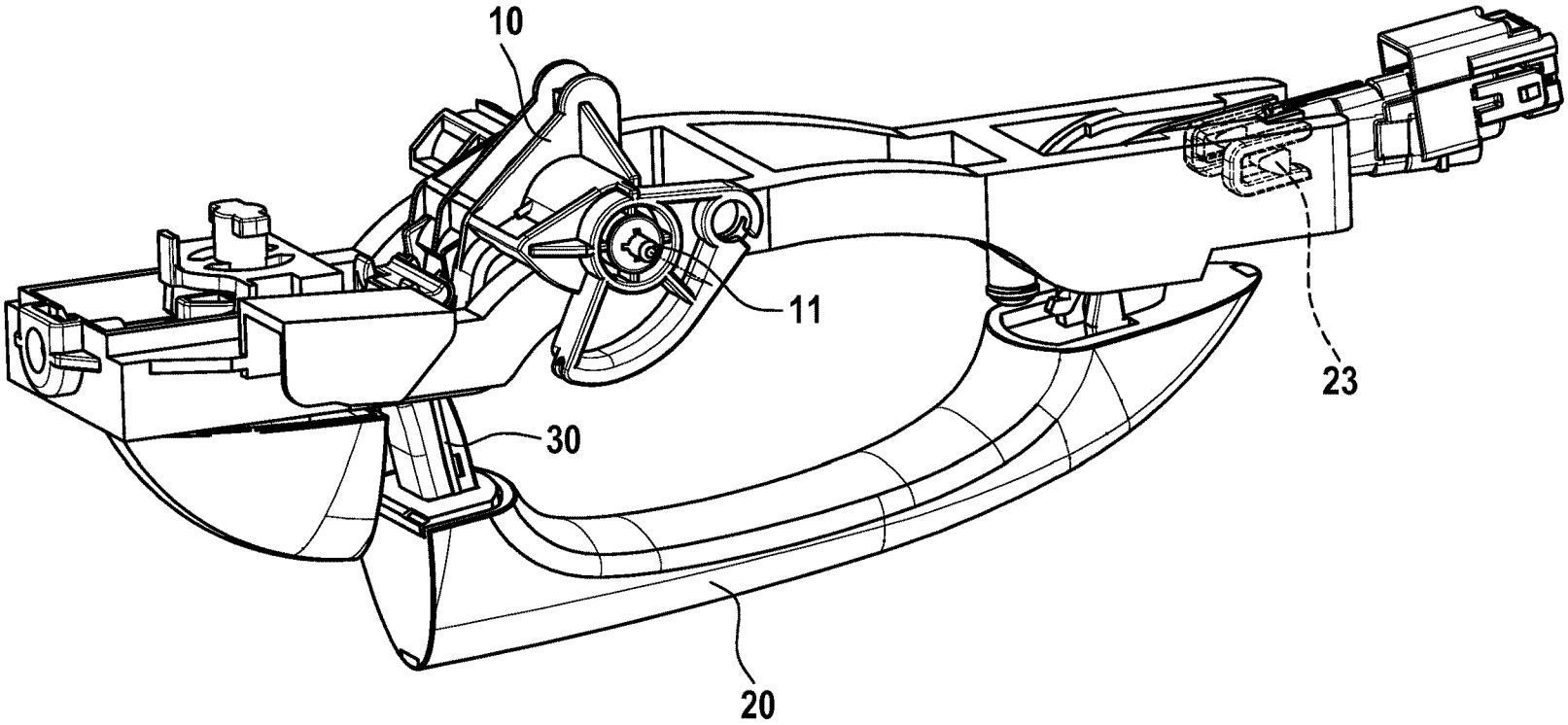

FIGS. 1 to 3 show a perspective view of a part of a motor vehicle door handle assembly for operating a motor vehicle door. FIGS. 1 and 2 show the assembly in the rest position, while FIG. 3 shows the assembly in the operating position, where the deflection lever 10 is displaced from the rest position according to FIGS. 1 and 2 into the operating position according to FIG. 3 by means of a rotation around its rotation axis 11. Said rotation of the deflection lever 10 into the operating position is effected by means of the displacement of the handle 20, which is kinematically coupled with the deflection lever 10, by means of a rotation around its rotation axis 23 into the operating position. In the operating position, the door lock is released by means of a coupling (not shown) of the deflection lever 10 with a motor vehicle door lock (not shown), provided that said door lock is not locked. As a result, the motor vehicle door (not shown) can be opened.

Figure 4:
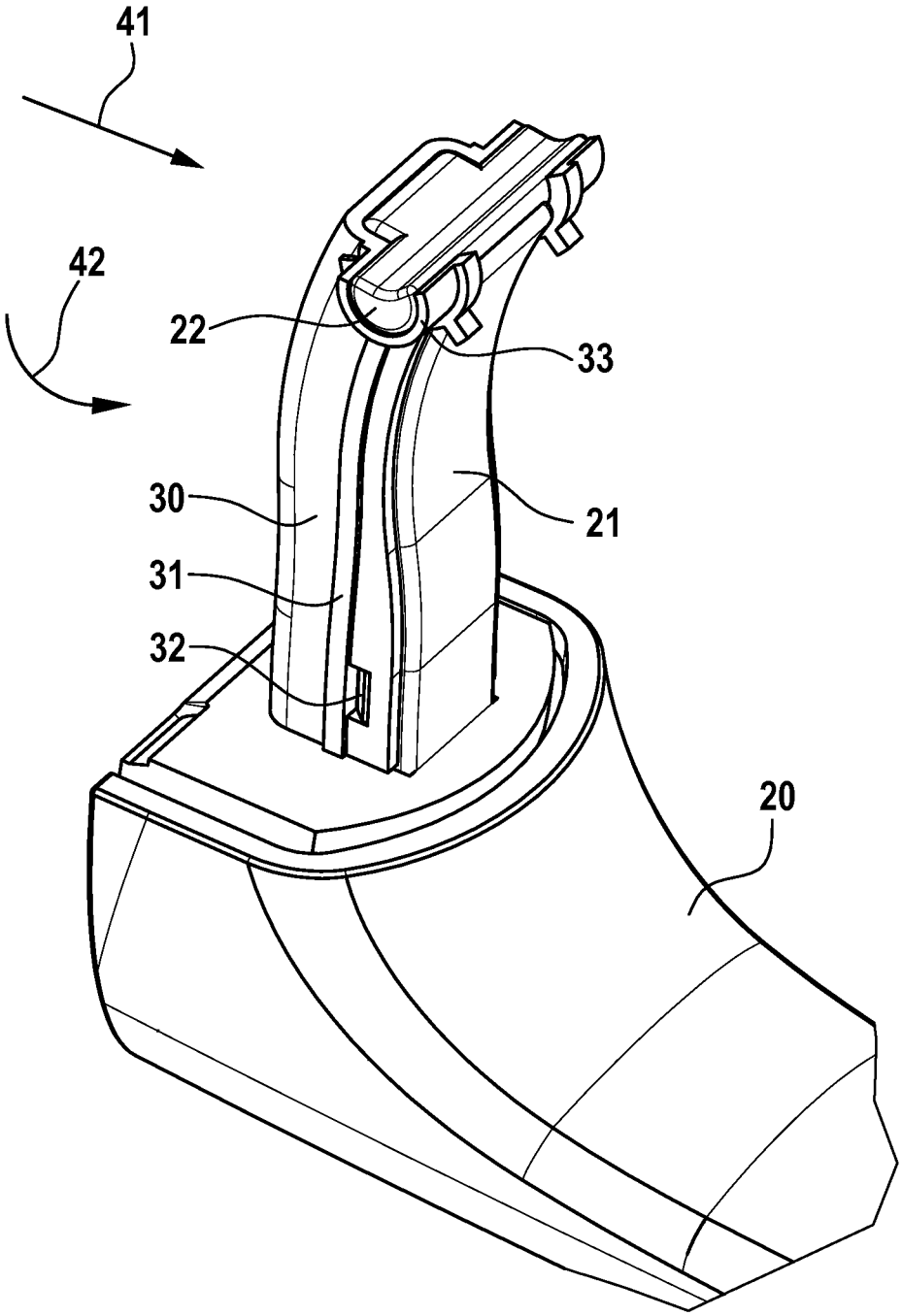

The handle 20 comprises a handle hook 21 on the free end opposite the rotary bearing 23, which hook is shown in an enlarged detail in FIG. 4. Laterally protruding stub shafts 22 are arranged on the free end of the handle hook 21, which stubs shafts are inserted into corresponding receptacles 13 on the deflection lever 10, as can particularly be seen in the enlarged depiction according to FIG. 5.

By means of the stub shafts 22 engaging into corresponding receptacles 13 on the deflection lever 10, the deflection lever 10 is kinematically coupled with the end of the handle hook 21 on the handle 20. This means that by a displacement of the handle 20 from the rest position according to FIGS. 1 and 2 into the operating position according to FIG. 3 at the same time the deflection lever 10 is displaced around its rotation axis 11 from the rest position according to FIGS. 1 and 2 into the operating position according to FIG. 3 by means of the kinematic coupling.

The deflection lever 10 is coupled to a door lock (not shown) of a motor vehicle by means of a Bowden cable pull (not shown). When displacing the deflection lever 10 into the operating position according to FIG. 3 by means of a rotation around its rotation axis 11, with the lock of the motor vehicle unlocked, the release of the lock is effected, which enables opening the motor vehicle door (not shown).

Per se, the handle 20 is supported in a handle housing (not shown) rotatable around its rotational axis 23. The rotation axis 23 thus forms a rotary bearing for the handle, which in a mounting situation on a motor vehicle is usually arranged to the front, while the free end of the handle 20 bearing the handle hook 21 is usually arranged to the rear in a mounting situation on a vehicle. However, the assembly within the vehicle is arbitrary.

FIG. 4 shows a perspective view of an enlarged detail of the handle hook 21 on the free end of the handle 20. The guidance element 30 is put onto the handle hook 21, which guidance element provides optimized sliding properties and a guidance for the handle 20, resulting in a minimized tilting clearance of the handle 20.

The guidance element 30 is configured U-shaped and engages around the handle hook 21 from three sides in a form-fit manner.

At the upper end of the handle hook 21 are discernable the stub shafts 22, which serve for the coupling of the handle hook with the deflection lever 10 not shown in FIG. 4. This coupling is discernable in FIG. 5, which is a perspective view of an enlarged detail of the motor vehicle door handle assembly with the handle hook in the mounting situation engaged with the deflection lever 10.

As can be seen in FIG. 4, the guidance element 30 in its contour comprises receiving spaces 33, which engage around the stub shafts 22 and thus form a sliding region for coupling with the deflection lever. The receiving spaces 33 on the guidance element 30 thus at the same time form bearing shells for stub shafts 22 of the handle hook 21. The guidance element 30 comprises longitudinal ribs 31 running along in the longitudinal direction on the side flanks. The guidance element 30 is configured symmetrically. Accordingly, the guidance element comprises a longitudinal rib 31 on its rear side which is not visible in the depiction. Here, the longitudinal direction is the direction which corresponds to the movement direction of the handle hook 21 when being displaced from the rest position into the operating position and vice versa.

The invention further relates to a method for mounting such a motor vehicle door handle assembly. The procedure of mounting the guidance element 30 to the handle hook 21 will be explained by FIG. 4. First, the guidance element 30 is plugged over the stub shafts 22 with its bearing shells 33 as indicated by arrow 41. After that, the guidance element 30 is pivoted around the axis of the stub shafts 22 as indicated by arrow 42. When doing so, the guidance element 30 is pushed onto the handle hook 21 all the way until the latching lugs arranged in the handle hook 21 engage and latch with the recesses 32. As can be seen in FIG. 4, the guidance element 30 engages around the handle hook 21 in a form-fit manner and thus forms a sliding shoe. The guidance element 30 is fixed at the handle hook 21 in a form-fit manner. The latching lugs arranged on the handle hook are latched into the recesses 32 in the guidance element 30. Thus, the guidance element is latched with the handle hook 21.

The guidance element 30 is made of a synthetic material which has optimized sliding properties. In the embodiment shown, the guidance element 30 is made of Polyoxymethylene POM. In contrast, the handle 20 and the handle hook 21 are made of a fiber-reinforced polyamide. Compared to this material—Polyamide—the guidance element 30 of Polyoxymethylene has improved sliding properties.

An optimum guidance of the handle 20 is achieved by the ribs 31 arranged on the sides of the guidance element 30, if said handle 20 is displaced from the rest position according to FIGS. 1 and 2 into the operating position according to FIG. 3 and vice versa.

Figure 5:
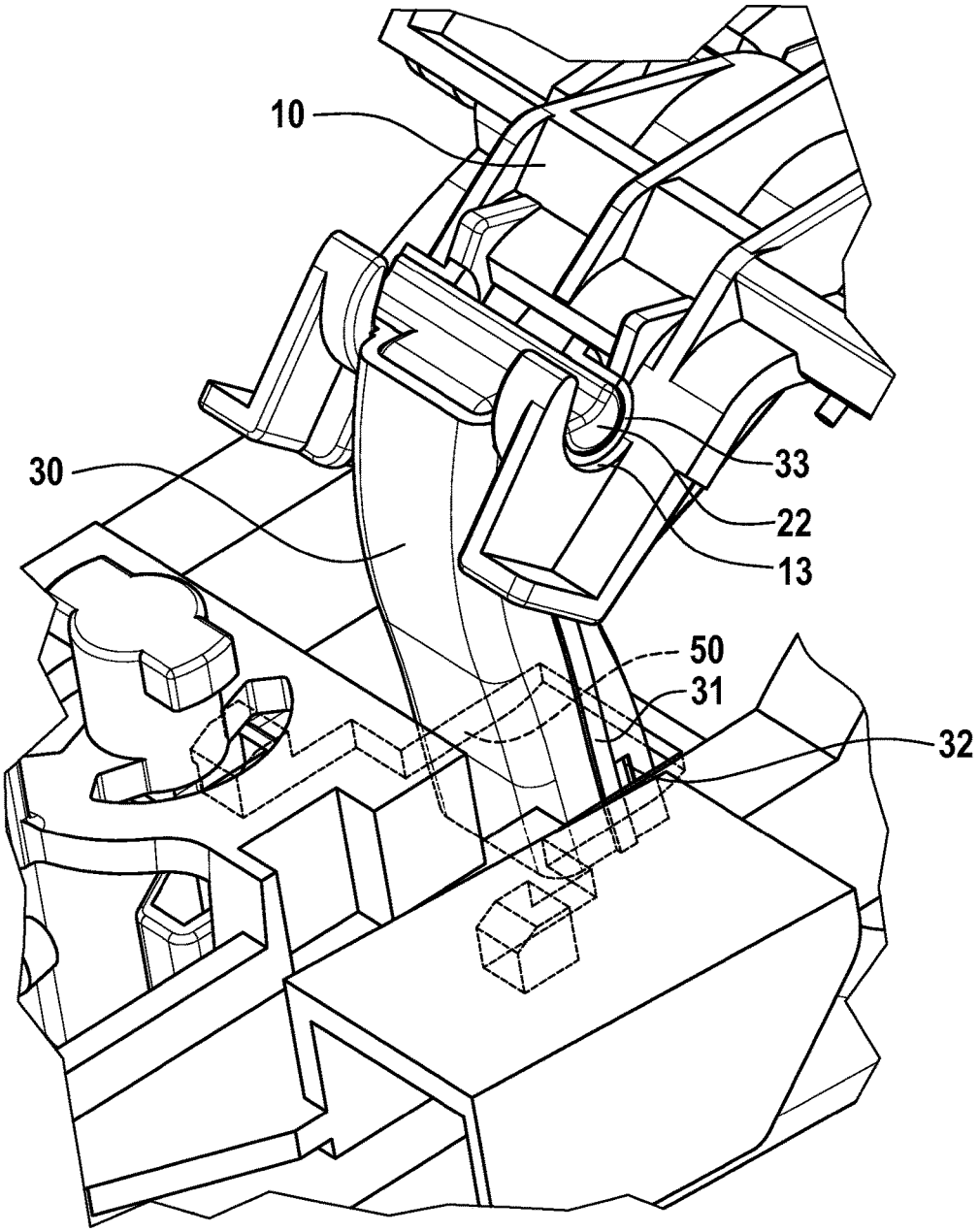
FIG. 5 an enlarged detail of the coupling region of handle hook and deflection lever in a perspective view.

As can be seen in FIG. 5, said rib 31 is guided and slides along on the handle support in a corresponding guidance profile in the housing of the motor vehicle door handle.

Further, the mounting situation shown in FIG. 5 illustrates how the guidance element 30 with the partially-cylindrical receiving area 33 on the one hand engages around the stub shafts 22 of the handle hook 21 and at the same time forms a sliding surface in the receptacles 13 of the deflection lever 10. Further, FIG. 5 also depicts the recesses 32 in the guidance element 30, which are engaged by the latching lugs on the handle hook 21, thus securing the guidance element 30 on the handle hook.

Thus, the guidance element 30 on the one hand provides a sliding element in the region of the coupling between stub shaft 22 and receptacles 13 in the kinematic coupling of handle hook 21 and deflection lever 10. Furthermore, the guidance element 30 forms a sliding shoe engaging around the handle hook 21. The guidance element 30 comprises lateral sliding ribs 31, which slide along in respective recesses in the guidance profile of the handle support 50.

The receptacles 33 forming bearing shells for coupling with the deflection lever 10 and the sliding region with the sliding rib 31 of the guidance element 30 are altogether formed in one piece made of synthetic material.

The fixing of the guidance element 30, which forms a sliding shoe for the handle hook 21, is effected in a form-fit manner, in that the bearing shells 33 on the upper end of the handle hook 21 engage around the stub shafts 22 and a clipping of the guidance element is effected on the lower end of the guidance element 30, in that corresponding latching lugs at the sides of the handle hook 21 engage into the recesses 32 in the guidance element 30.

By arranging the guiding ribs 31 on the sides of the guidance element 30, an improved guidance of the handle 20 is produced, compensating the tilting clearance of the rotary bearing 23 of the handle 20.

Figure 6A:
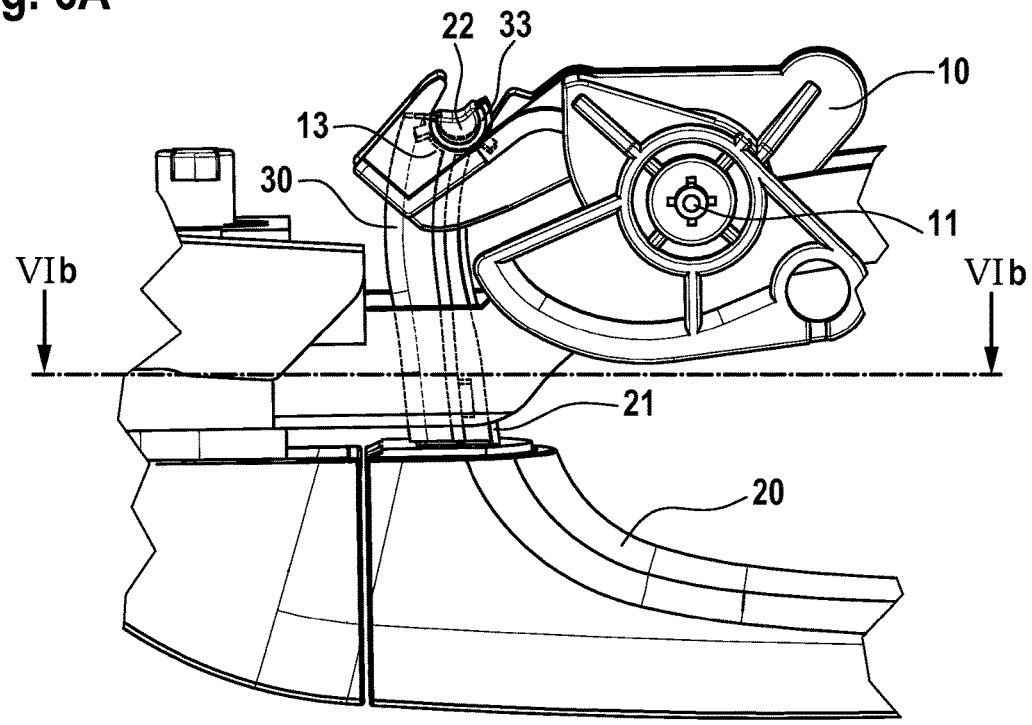
FIG. 6A an enlarged detail of the coupling region of handle hook and deflection lever in a side view FIG. 6B the section VI-VI according to FIG. 6A.
Figure 6B:
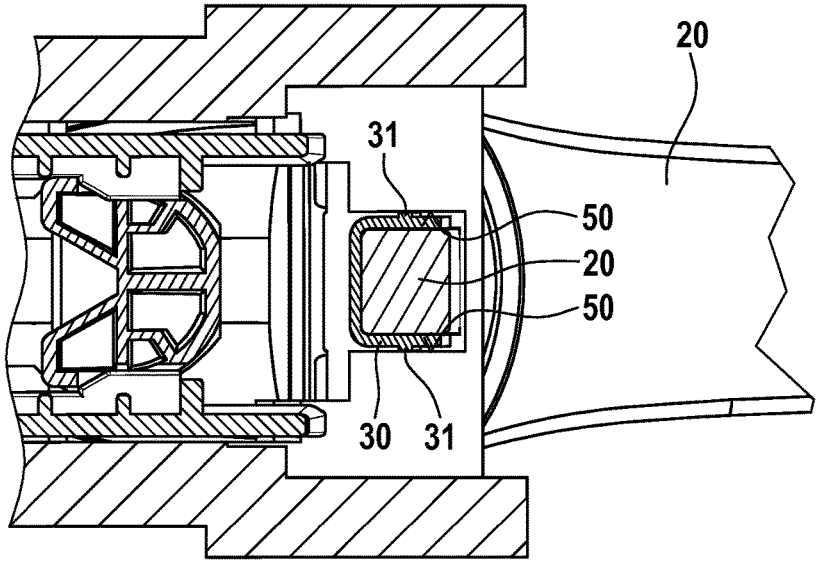

FIG. 6A shows an enlarged detail of the side view of the handle hook 21 coupled with the deflection lever 10. Discernable again is one of the bearing shells 33, which is arranged in region of the coupling between the stub shaft 22 on the handle hook 21 and the respective receiving space 13 on the deflection lever 10. Furthermore, the guidance element 30 engaging around the handle hook 21 is discernable in the side view according to FIG. 6A. FIG. 6B shows the section VI-VI according to FIG. 6A, particularly illustrating the interplay between outer ribs 31 and the respective profile in the handle housing 50.

Figure 7:
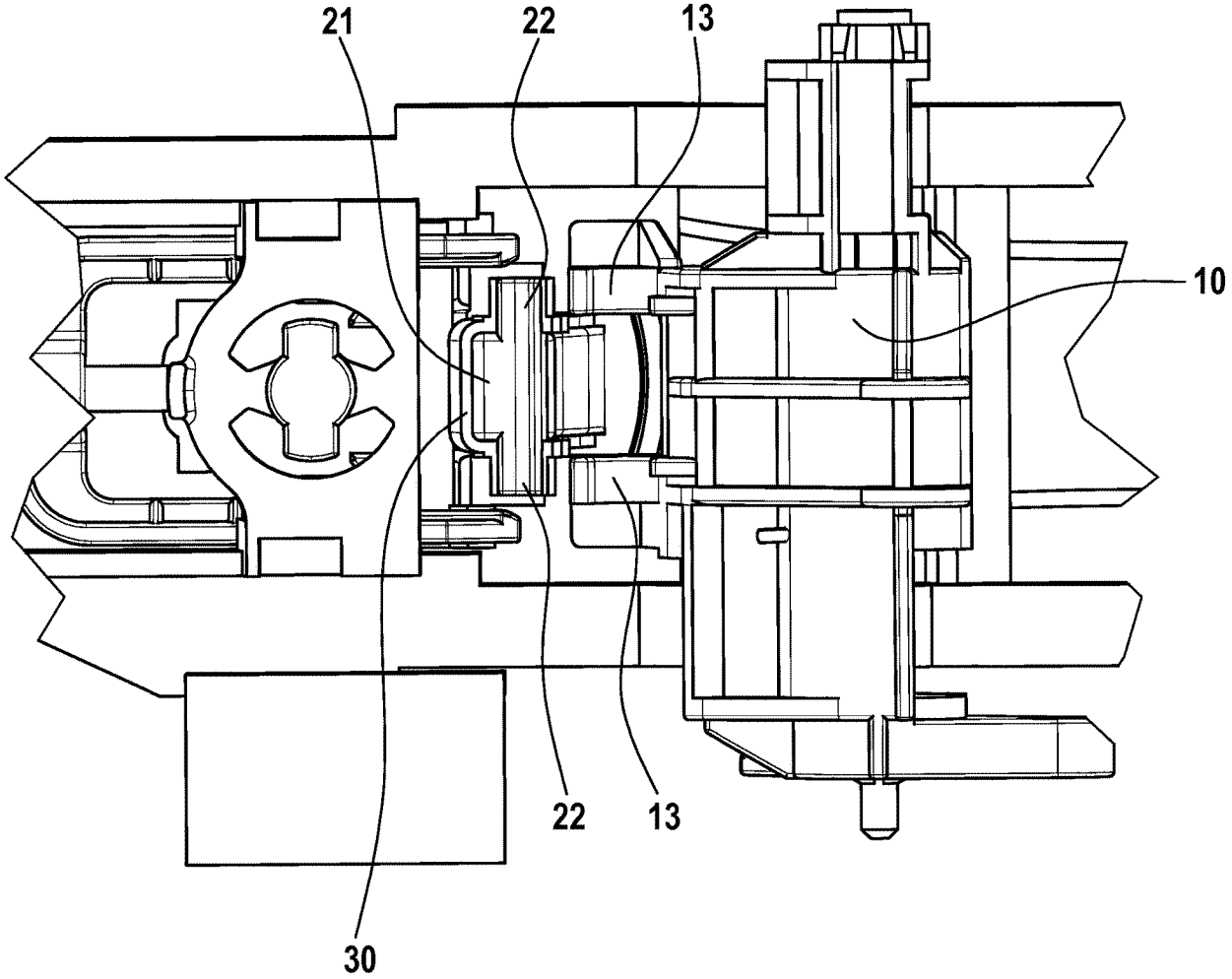
FIG. 7 an enlarged detail of the coupling region of handle hook and deflection lever before the handle hook is inserted in the receiving spaces on the deflection lever in a top view.
Figure 8A:
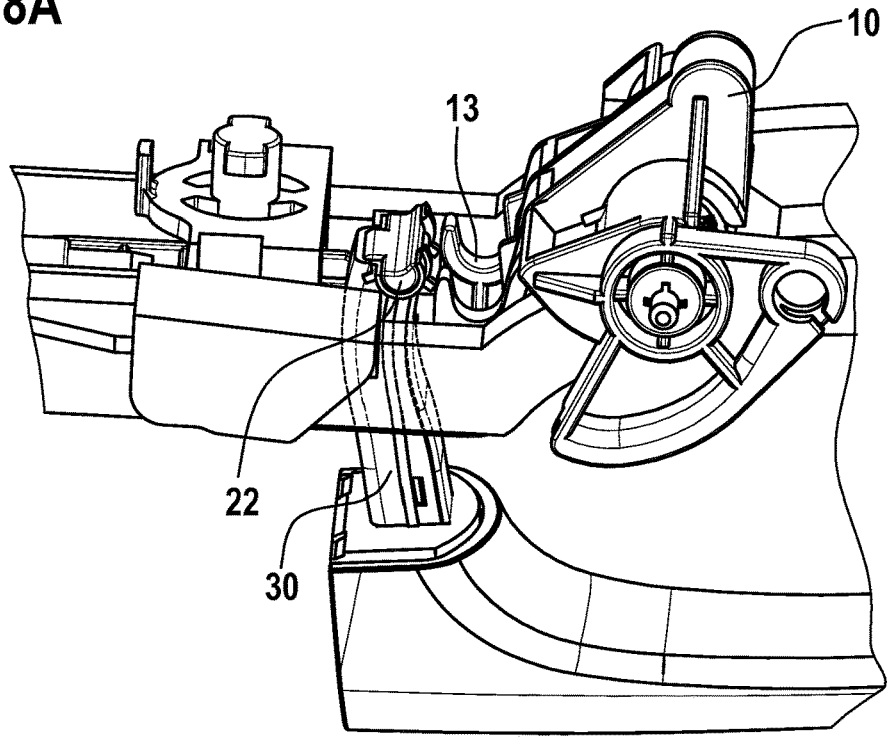
FIG. 8A an enlarged detail of the coupling region of handle hook and deflection lever in perspective views before the handle hook is inserted into the receiving spaces on the deflection lever.
Figure 8B:
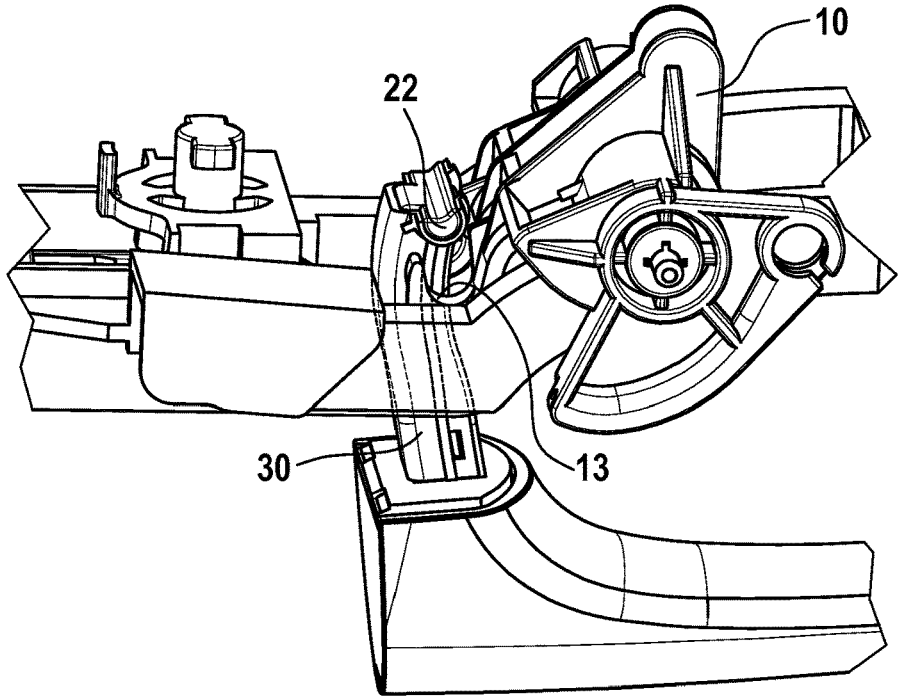
FIG. 8B an enlarged detail of the coupling region of handle hook and deflection lever in perspective views during insertion of the handle hook in the receiving spaces on the deflection lever.
Figure 9:
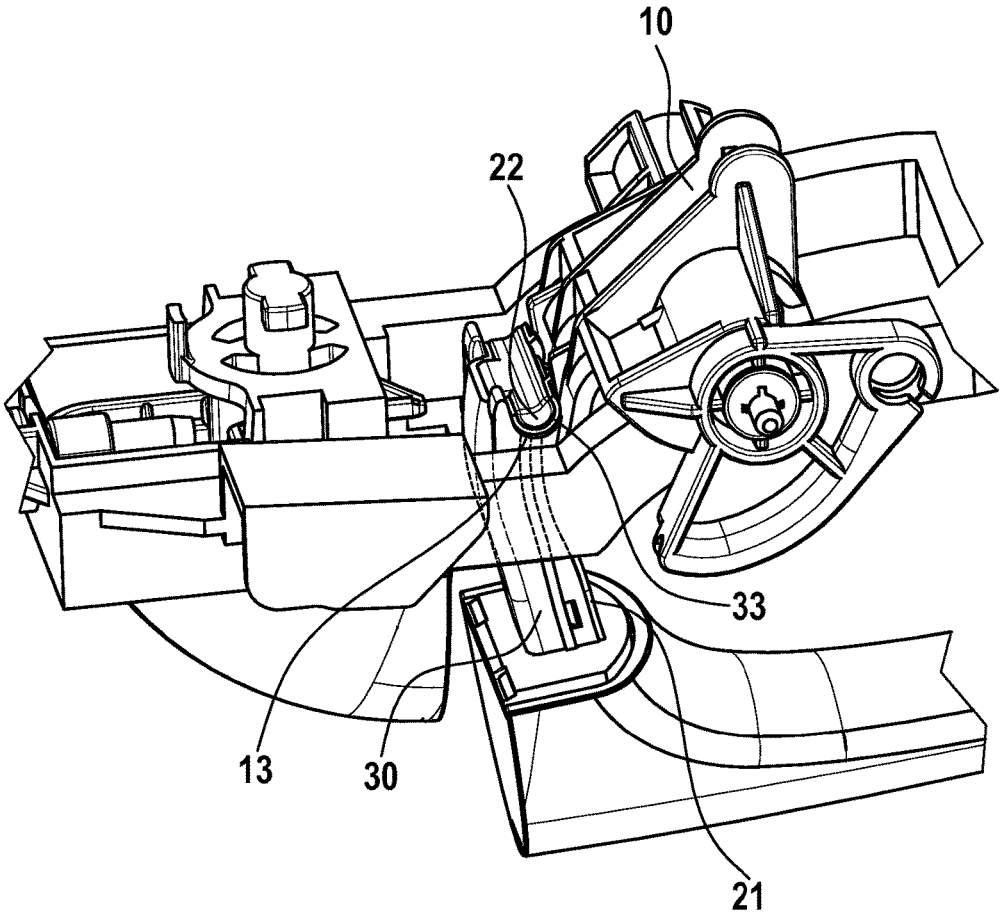
FIG. 9 an enlarged detail of the coupling region of handle hook and deflection lever in a perspective view after insertion of the handle hook in the receiving spaces on the deflection lever.

The mounting of the handle 20 with the handle hook 21 and the deflection lever 10 is explained by means of FIGS. 7 to 9.

FIG. 7 shows an enlarged detail of a plan view onto the assembly prior to the insertion of the handle hook 21 with the stub shafts 22 along with the bearing shells 33 into the respective receptacles 13 of the deflection lever 10. To that end, according to FIG. 8A, the handle hook 21 with the pre-mounted guidance element 30 is pushed into the assembly from below, and then inserted in the receiving region 13 on the deflection lever according to FIG. 8B.

FIG. 9 shows the mounting situation upon assembly, in which the stub shafts 22 surrounded by the bearing shells 33 are inserted in the receiving regions 13 of the deflection lever 10.

As a result of the fact that the guidance element 30 is made of a material different from that of the handle 20 with the handle hook 21, a good sliding pair is formed, reliably preventing undesired noise upon actuation of the handle 20.

In the example shown, a fiber-reinforced polyamide material is used for the handle 20 and the handle hook 21, such a glass-fiber reinforced material having insufficient sliding properties however. For this reason, the guidance element 30 is made of Polyoxymethylene, which offers better sliding properties than the glass-fiber reinforced polyamide material of the handle 20.

Thus, a guidance relative to the deflection lever 10 is realized by means of the guidance element 30, in that the guidance element 30 with the bearing shells 33 engages around the stub shafts 22 of the handle hook 21 and is inserted in the receptacles 13 of the deflection lever 10. At the same time, the guidance element 30 forms a lateral guidance relative to the handle housing 50, hereby compensating the tilting clearance of the rotary bearing 23 of the handle 20. This provides the user with a more comfortable haptic impression.

As a result of the fact that the guidance element 30 forms both the coupling region between stub shafts 22 and receptacle 13, i.e. the coupling region of the kinematic coupling between the handle hook 21 and deflection lever 10, and at the same time a guidance of the handle hook 21 relative to the handle housing 50, optimized sliding pairs are arranged on all points of kinematic couplings as well as in all guiding regions.

The invention claimed is:

1. A door handle device for a motor vehicle, the door handle device having a handle, which is arranged in a handle housing and which is displaceable from a rest position into an operating position by means of rotation around a rotation axis, wherein a handle hook, arranged on a free end of a rear side of the handle, is kinematically coupled with a deflection lever, wherein the deflection lever, when being displaced from a rest position into an operating position, indirectly, acts on a motor vehicle door lock to effect a release of the motor vehicle door lock and to allow opening a motor vehicle door, wherein the handle hook comprises at least one guidance element by means of which the handle hook is guided in a corresponding profile of the handle housing, the at least one guidance element form-fittingly engaging with the handle hook, wherein the handle hook, on a free end thereof, comprises laterally protruding coupling pins, which are inserted into corresponding recesses on the deflection lever.

2. The door handle device for a motor vehicle according to claim 1, wherein the at least one guidance element at least partially form-fittingly engages around the coupling pins.

3. The door handle device for a motor vehicle according to claim 1, wherein the at least one guidance element is configured as a U-shaped profile engaged over the handle hook.

4. The door handle device for a motor vehicle according to claim 1, wherein the at least one guidance element comprises latching lugs, which engage into undercuts or recesses in the handle hook.

5. The door handle device for a motor vehicle according to claim 1, wherein the at least one guidance element comprises latching lugs, which engage into undercuts or recesses or breakthroughs in the at least one guidance element.

6. The door handle device for a motor vehicle according to claim 1, wherein the at least one guidance element comprises positive guidance profiles running longitudinally, which interact with negative guidance profiles in the corresponding profile of the handle housing so as to guide the handle hook.

7. The door handle device for a motor vehicle according to claim 1, wherein the at least one guidance element comprises negative guidance profiles running longitudinally, which interact with positive guidance profiles in the corresponding profile of the handle housing so as to guide the handle hook.

8. The door handle device for a motor vehicle according to claim 1, wherein the handle and the handle hook are formed in one piece.

9. The door handle device for a motor vehicle according to claim 1, wherein the at least one guidance element is made of a synthetic material.

10. The door handle device for a motor vehicle according to claim 8, wherein the handle and the handle hook are formed from fiber reinforced polyamide.

11. The door handle device for a motor vehicle according to claim 9, wherein the at least one guidance element is made from polyoxymethylene.

* * * * *